United States Patent [19]

Torikai et al.

[11] 4,361,602

[45] Nov. 30, 1982

[54] METHOD FOR PRODUCTION OF POSITIVE ELECTRODE FOR ELECTROLYSIS OF WATER

[75] Inventors: Eiichi Torikai, Yao; Youji Kawami, Kawachi-Nagano; Noboru Wakabayashi, Ikeda, all of Japan

[73] Assignees: Agency of Industrial Science & Technology; Ministry of International Trade & Industry, both of Tokyo, Japan

[21] Appl. No.: 302,133

[22] Filed: Sep. 14, 1981

[51] Int. Cl.[3] ..... C23C 3/02

[52] U.S. Cl. ..... 427/123; 106/1.24; 106/1.28; 204/292; 204/293; 427/437; 427/438

[58] Field of Search ..... 106/1.24, 1.28; 427/123, 437, 438; 204/292, 293

[56] References Cited

U.S. PATENT DOCUMENTS

| | | | |
|---|---|---|---|
| 2,990,296 | 6/1961 | Hoke | 427/438 |
| 3,485,597 | 12/1969 | Pearlstein | 427/438 |
| 4,184,941 | 1/1980 | Carlin | 427/123 |
| 4,224,133 | 9/1980 | Takahashi | 204/292 |

FOREIGN PATENT DOCUMENTS

| | | | |
|---|---|---|---|
| 747872 | 12/1966 | Canada | 427/437 |

OTHER PUBLICATIONS

Mallory, "The Electroless Nickel-Boron Plating Bath; Effects of Variables on Deposit Properties", *Plating*, Apr. 1971, pp. 319-327.

*Primary Examiner*—John D. Smith

*Attorney, Agent, or Firm*—Oblon, Fisher, Spivak, McClelland & Maier

[57] ABSTRACT

A positive electrode suitable for the electrolysis of water is produced by immersing a nickel electrode in an aqueous solution containing a nickel salt, a rhodium salt, and an alkyl amine borane.

4 Claims, 3 Drawing Figures

METHOD FOR PRODUCTION OF POSITIVE ELECTRODE FOR ELECTROLYSIS OF WATER

BACKGROUND OF THE INVENTION

This invention relates to a method for the production of a positive electrode for use in the electrolysis of water, and more particularly to a method for the production of a positive electrode to be used in a system for generating hydrogen and oxygen by the electrolysis of an aqueous alkali solution.

The method of electrolyzing an aqueous alkali solution such as, for example, an aqueous solution of potassium hydroxide or sodium hydroxide thereby producing hydrogen at a negative electrode and oxygen at a positive electrode has long been known as a technique suitable for commercial production of hydrogen. In recent years, active studies are being carried out in search for ways of enhancing the efficiency of this method of electrolysis of water. Generally as means for enhancing the energy efficiency in the electrolysis, there are adopted means for improving diaphragms and electrode structures with a view to lowering the electrolytic resistance offered by electrolytes or gas bubbles and means for lowering over-voltages at the electrodes. In the case of the electrolysis of aqueous alkali solutions, the means for lowering overvoltages at the electrodes has attracted special attention.

As measures useful for this purpose, there have been proposed oxide electrodes and nickel electrodes of increased surface area. The former electrodes have their surfaces coated with oxides possessed of high catalytic activity in the reactions causing production of oxygen at the positive electrodes. The electrodes obtained by causing spinel type oxides such as of nickel, cobalt, and iron or perovskite type oxides containing rare earth elements to be compression molded in conjunction with a binder on substrate electrodes can be cited as examples. As examples of the latter electrodes, the so-called surface-enlarged nickel electrodes having their operating surfaces enlarged by means of sintering, flame coating, eluting, etc. can be cited. Concerning the electrolysis of aqueous alkali solutions, however, there is a constant demand for increased efficiency. For example, a strong need is felt for carrying out high-temperature electrolysis at a high current density. When the aforementioned oxide type electrodes and surface-enlarged electrodes are used under such harsh conditions, however, they undergo layer separation, structural disintegration, and electrolytic corrosion and cannot be expected to provide the required long periods of service. To be specific, oxide-coated electrodes are deficient in physical strength and surface-enlarged electrodes, though possessed of higher physical strength than the oxide-coated electrodes, tend to entail gradual increase of anodic potential during their operation. These degradations by aging are aggravated in proportion as the temperature is raised and the current density is increased. In the case of an electrolysis performed under the conditions of 50 $A/dm^2$ and 100° C., for example, an increase of the order of 0.05 to 0.1 V is observed in the anodic potential after 500 hours of operation. This phenomenon is ascribable to the increase in the electric resistance offered by $NiO_2$, an oxide of higher order to which an oxide of lower order, NiOOH, initially formed on the surface of the nickel electrode is gradually converted. The surface-enlarged nickel electrodes enjoy notable improvement in anodic potential as compared with smooth-faced or reticular nickel electrodes because of their substantially increased surface area. They nevertheless have a disadvantage that so far as their operating surfaces are those of nickel, they inevitably suffer elevation of bath voltage which occurs in consequence of the stabilization of oxides.

The inventors carried out a long-term study in search for a method capable of preventing the aforementioned surface-enlarged nickel electrodes from loss of activity. They have found that these electrodes are most active and suffer least from degradation by aging when they are coated with rhodium, and have completed a method for effecting the coating of the electrodes with rhodium by the electroplating technique.

The electroplating technique, however, entails a variety of difficulties. For example, surface-enlarged nickel electrodes are readily corroded by a sulfuric acid plating bath. Besides, it is extremely difficult to effect uniform plating to the recesses of complicatedly shaped pores formed into the electrodes. To make the matter worse, the increase in the thickness of the coat formed by the plating which is necessary for the purpose of enhancing the fastness of the adhesion of the coat adds to the cost of plating.

The inventors made a study to seek a method for coating nickel electrodes with rhodium by a chemical plating technique instead of the electroplating technique. It has long been held that chemical deposition of rhodium, by nature, is extremely difficult to accomplish. Very few formulas for this chemical deposition have been reported to the art. In fact, an attempt to deposit rhodium on the substrate of a nickel electrode by following the example of the method generally applied to chemical deposition of nickel, cobalt, palladium, or silver, i.e. by formulating a plating bath incorporating a reducing agent such as a hydrogenated boron compound or amine borane in an aqueous solution of antimony or ethylene diamine and treating the nickel electrode in the bath while using varying combinations of pH and temperature conditions fails to provide selective growth of rhodium on the surface of the nickel electrode. For the chemical plating of the nickel electrode with rhodium, therefore, this method is impracticable.

An object of this invention is to provide a method for the production of a positive electrode for use in the electrolysis of water, which method comprises coating a nickel electrode with rhodium by a chemical plating technique.

SUMMARY OF THE INVENTION

The inventors continued a study with a view to developing an activating agent effective for the plating of the nickel electrode with rhodium. Consequently, they have found that desired plating of the nickel substrate with rhodium is accomplished by using a plating bath comprising a rhodium salt and an amine borane type compound and further incorporating a nickel salt. This knowledge had led to perfection of the present invention. To be specific, this invention relates to a method for the production of a positive electrode for use in the electrolysis of water, characterized by immersing a nickel electrode in an aqueous solution containing a nickel salt, a rhodium salt and an alkylamine borane and having the nickel salt and the rhodium salt in amounts such that the molar ratio of nickel to rhodium falls in the range of from 0.01 to 2.0.

DESCRIPTION OF THE PREFERRED EMBODIMENTS

Figure 1:
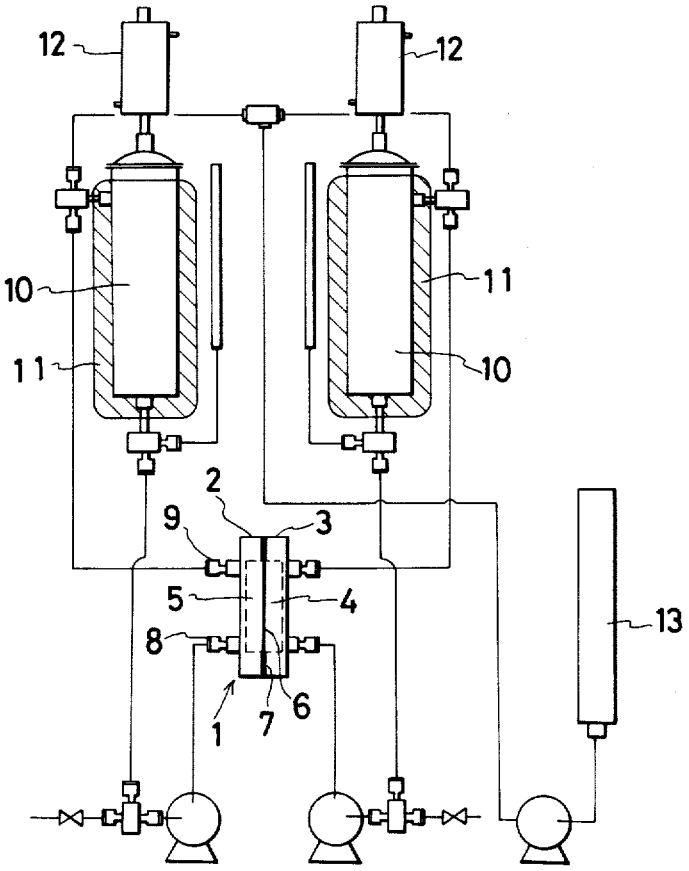
FIG. 1 is an electrolytic device used in working examples and comparative experiments cited herein.

The method of this invention uses as a plating bath an aqueous solution containing a nickel salt, a rhodium salt, and an amine borane type compound, and this method is characterized by the fact that, in this plating bath, nickel serves as an activating agent for the chemical plating of the nickel substrate with rhodium.

When the inventors, during the study mentioned above, tried the chemical plating of the nickel substrate with rhodium by using, as an activating agent therefor, cobalt, platinum, ruthenium, etc. capable of catalyzing contact reduction instead of nickel, they learned that these metals brought about absolutely no discernible effect.

In other words, they ascertained that a nickel salt alone is effective as an activating agent for the chemical plating of the nickel substrate with rhodium.

The nickel salt to be used in the present invention must be a water-soluble salt. Examples are halogenides, nitrate, and sulfate. This nickel salt can be added all at once to the aqueous solution under preparation or be gradually added to the plating bath while the plating is under way.

The rhodium salt to be used herein must be a water-soluble salt. Examples are chloride, bromide, perchlorate, and sulfate. Such a rhodium salt is generally used in the form of an ammonia aqueous solution of a concentration in the range of from 0.1 to 0.01 mol/liter. When the concentration is higher than the upper limit of the range mentioned above, the ammonia water induces precipitation of rhodium as a hydroxide. To preclude this precipitation, there can be added a complexing agent such as ethylene diamine.

The alkylamine borane to be effectively used in the present invention is represented by the formula, $R_3N.BH_3$ (wherein, R denotes a hydrogen atom or a lower alkyl group). Concrete examples are $NH_3.BH_3$, $CH_3NH_2.BH_3$, $(CH_3)_2NH.BH_3$, $(CH_3)_3N.BH_3$, and $(C_2H_5)_2NH.BH_3$.

Such reducing agents as hydrazine, hypophosphorus acid, and hydrogenated boron compound which are generally used for the precipitation of other metals are invariably undesirable from the standpoints of practical reducing speed, catalytic activity of formed plate, and durability.

The amounts of the nickel salt and the rhodium salt to be added to the plating bath are such that the molar ratio of nickel to rhodium falls in the range of from 0.01 to 2.0, preferably from 0.1 to 0.5. If this molar ratio exceeds 2.0, the desired effect cannot be obtained because the amount of the formed plate of rhodium is less than is required. If the molar ratio is less than 0.01, the selective deposition of rhodium on the nickel surface proceeds with difficulty.

The concentrations of the nickel salt, the rhodium salt and the alkylamine borane in the plating bath are required to fall in the respective ranges of 0.3 to 2.0 g, 0.5 to 1.2 g, and 0.5 to 1.5 g in 1000 cc of the plating bath. If the concentrations exceed the upper limits of the ranges, the plating speed increases and the rhodium salt is deposited and precipitated on the walls and the bottom of the plating bath to cause heavy loss of rhodium. If the concentrations fail to reach the lower limits of the ranges, the plating proceeds with great difficulty and consumes enormous time. In the worst case, virtually no plating can be obtained.

As regards the plating conditions suitable for the purpose of this invention, the pH value of the plating bath is desired to fall in the range of from 7 to 14, preferably from 9 to 12 and the temperature to fall in the range of from 50° to 90° C., preferably from 60° to 80° C. The reason for these particular plating conditions has bearing upon the plating speed. When these conditions are not fulfilled, the fastness with which the rhodium plate adheres to the nickel substrate is not obtained at the best level.

The chemical plating of the present invention is based on the mechanism that active nickel is first deposited on the surface of the nickel substrate to promote the activation of the surface and subsequently rhodium or rhodium-nickel alloy is formed on the activated surface. As the nickel substrate to be plated with rhodium by this invention, various kinds of surface-enlarged nickel electrodes can be used. Examples are nickel electrodes in the form of porous plates, reticular plates, foamed plates, sintered plates, similar plates having fine nickel particles sintered thereon, similar plates having a nickel-aluminum alloy plasma sprayed thereon and further developed with an aqueous alkall solution, and similar plates plated with a nickel-zinc alloy and subsequently deprived of zinc by an alkali elution method. These nickel electrodes are desired to have a large surface area and high physical strength (enough to resist deformation).

For this invention, the nickel electrode which has its surface enlarged generally for the purpose of enhancing activation is used preferably, although the shape of the electrode is not specifically limited. Such surface-enlarged nickel electrodes can be produced by any of a variety of methods. Surface-enlarged nickel electrodes produced by heretofore known methods such as sintering method, fusion method, and flame coating method can be cited as examples. For use in the electrolysis of water as contemplated by this invention, a porous nickel plate containing hollows suitable for desired distribution of a gas-liquid mixture and having a relatively high porosity is used as the substrate. This substrate is treated by any of the conventional suitable methods to have its surface coated or perforated and consequently enlarged.

Now the present invention will be described specifically with reference to working examples and comparative experiments.

EXAMPLE 1 AND COMPARATIVE EXAMPLE 1

A conventional electrode, a surface-enlarged electrode, and an electrode treated by the method of this invention were used as positive electrodes and tested for current density and bath voltage to determine their relation.

The electrolytic device used for the test was constructed as follows: A cell was formed by enclosing the electrodes (cathodic electrode and anodic electrode) and a diaphragm in a fluorine rubber packing (product of Asahi Glass Co.) and holding this arrangement between two flanges (150 mm in diameter and 15 mm in thickness) made of nickel as illustrated in FIG. 1. In the diagram, 1 denotes a cell, 2 and 3 each denote a flange made of nickel, 4 denotes a positive electrode, 5 denotes a negative electrode, 6 denotes a diaphragm, and 7 denotes a rubber packing. An electrolyte was introduced through a lower portion 8, passed between the electrodes or between the electrodes and the diaphragm, and discharged through an upper portion 9. The diaphragm was made of a composite material obtained by filling a perforated Teflon sheet with potassium titanate (effective resistance 0.28 $\Omega$-cm$^2$ at 25° C.). A container 10 having an inner volume of 2 liters and made of nickel and adapted to serve as a combination gas-liquid separator and bath liquid storage tank was provided with a heater 11 so as to permit temperature control between room temperature and 110° C. And, 12 denotes a condenser and 13 a water tank.

The positive electrodes used in the test were a flat-plate nickel electrode (80 mm in diameter and 0.5 mm in thickness), a porous nickel electrode (foamed nickel plate 80 mm in diameter and 5 mm in thickness having an apparent density of 0.27 g/cm$^2$ and a specific surface area of 1000 m$^2$/m$^3$, made by Sumitomo Electric Industry Co., Ltd., and marketed as "Celmet No. 2"), a surface-enlarged electrode prepared by coating the aforementioned porous nickel electrode with a nickel-aluminum alloy (Ni/Cl=4/1 by weight ratio) deposited to a thickness of 10 to 100 microns by the plasma flame coating method and thereafter developed with a 5 N aqueous NaOH solution, and an electrode prepared by the method of this invention, i.e. an electrode obtained by treating the aforementioned surface-enlarged electrode with a plating bath A of Example 2.

Figure 2:
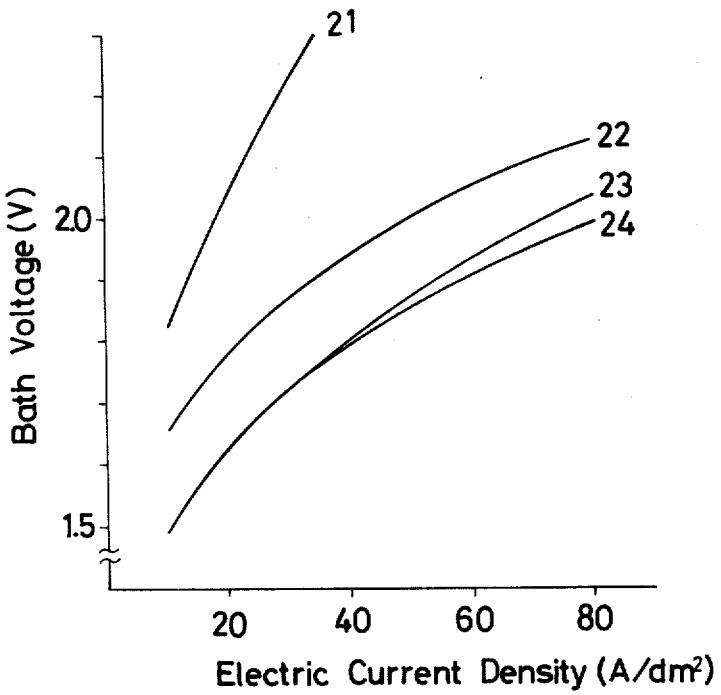
FIG. 2 is a graph showing the relations between current densities and bath voltages involved in working examples and Comparative Experiment 1.

The bath was 40 percent aqueous KOH solution and the negative electrodes were those made of the same materials as positive electrodes. The electrolysis was performed at a fixed temperature of 100° C. The results were as shown in FIG. 2. In the graph, the curve 21 represents the results obtained for the flat-plate nickel electrode, the curve 22 those obtained for the porous nickel positive electrode, the curve 23 those obtained for the surface-enlarged positive electrode coated with an aluminum alloy and developed with an alkali, and the curve 24 those obtained for the positive electrode produced by the method of this invention.

As is clear from FIG. 2, the surface-enlarged electrode 23 showed a notable effect in connection with lowering of bath voltage as compared with the flat-plate electrode 21 and the porous nickel electrode 22, and the electrode 24 of this invention coated with rhodium showed a much lower bath voltage.

Figure 3:
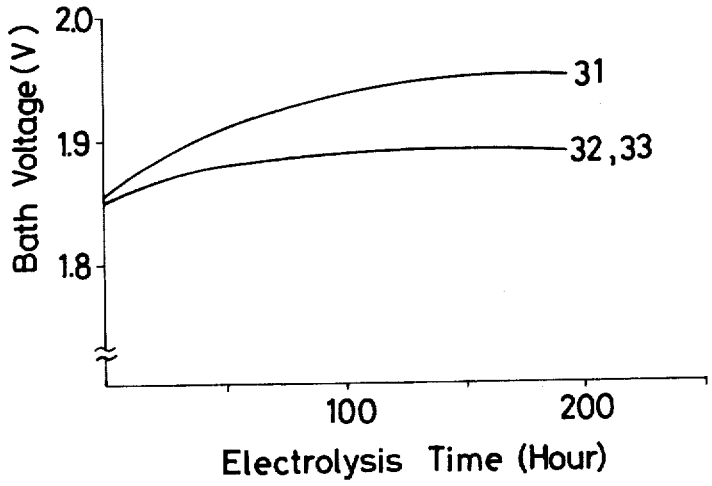
FIG. 3 is a graph showing changes in bath voltage when electrolyses were continued in working examples and Comparative Experiment 2.

The electrolysis was continued under the conditions of 100° C. and 50 A/dm$^2$ to compare the aforementioned electrode of the present invention and the other electrodes mentioned above with respect to changes in bath voltage. The results were as shown in FIG. 3. In the graph, the curves 31 and 33 represent the results obtained for the same electrodes which gave the results of the curves 23 and 24 in the graph of FIG. 2 and the curve 32 represents the results obtained for an electrode like the electrode 23 but coated with rhodium. It is noted from FIG. 3 that while the electrode 31 shows a bath voltage increase of 0.4 V after 100 hours of electrolysis and of 0.7 V after 500 hours of electrolysis, the electrodes 32 and 33 coated with rhodium show substantially no increase of bath voltage and, therefore, permit stable electrolysis for a very long time.

EXAMPLE 2 AND COMPARATIVE EXAMPLE 2

The following three plating baths were prepared.

| | |
|---|---|
| Plating bath A: | |
| Rhodium chloride ($RhCl_3.2H_2O$) | 1.0 g |
| Nickel chloride ($NiCl_2.6H_2O$) | 0.4 g |
| Ammonia water | 30 ml |
| Water (total volume) | 1000 ml |
| Dimethylamine borane (5 percent ethyl alcohol solution) | 20 ml |
| Plating bath B: | |
| Rhodium sulfate ($RhSO_4.4H_2O$) | 1.0 g |
| Nickel sulfate ($NiSO_4.6H_2O$) | 0.3 g |
| Ammonia water | 80 ml |
| Water (total volume) | 1000 ml |
| Dimethylamine borane (5 percent ethyl alcohol solution) | 20 ml |
| Plating bath C: | |
| Rhodium chloride | 1.0 g |
| Nickel chloride | 2.0 g |
| Ammonia water | 30 ml |
| Water (total volume) | 1000 ml |
| Dimethylamine borane (5 percent ethyl alcohol solution) | 20 ml |

From a foamed nickel substrate (80 mm in diameter and 5 mm in thickness, having an apparent density of 0.27 g/cm$^3$ and a specific surface area of 1000 m$^2$/m$^3$, made by Sumitomo Electric Industry Co., Ltd. and marketed as "Celmet No. 2"), two types of surface-enlarged electrodes were prepared as described below. A Raney nickel type surface-enlarged electrode was obtained by coating the nickel substrate with a nickel-aluminum alloy (Ni/Al=4/1 by weight ratio) deposited to a thickness of 10 to 100 microns by the plasma flame coating technique and subsequently developing the deposited coat with a 5 N aqueous NaOH solution. An ultra-fine powder sintered type surface-enlarged electrode was obtained by applying to the surface of the nickel substrate an aqueous dispersion formed of an ultra-fine nickel powder of an average particle diameter of 100 A and carboxymethyl cellulose at a rate such that the nickel powder was deposited thereon in an amount of 0.02 to 0.2 g per g of the nickel substrate and subsequently burning the coated nickel substrate in an atmosphere of hydrogen at 600° C.

The two surface-enlarged electrodes described above were plated in the aforementioned plating baths A–C under the following conditions.

| Plating bath | Amount of bath (ml) | Temperature (°C.) | Plating time (hr) | Amount of rhodium deposited (mg) |
|---|---|---|---|---|
| A | 100 | 70 | 1.0 | 40–45 |
| B | 100 | 70 | 1.0 | 35–36 |
| C | 100 | 60 | 1.0 | 40–45 |

The evaluation of the performance of these electrodes was carried out by treating the electrodes by the electrolytic device illustrated in FIG. 1.

The electrolyte, a 40 percent aqueous KOH solution, was circulated through the electrolytic cell at a rate of 0.5 to 1.0 liter/min.

The positive electrodes used in the test were surface-enlarged electrodes which had undergone no plating treatment and surface-enlarged electrodes which had been treated with the three plating baths A, B, and C according to the present invention.

The electrolysis was performed by applying voltage to the nickel terminal plates. After about five hours of breakin run at 20 A/dm$^2$, the relation between current density and bath voltage was measured at a fixed temperature of 110° C. The results were as shown in Table 1 below.

TABLE 1

| No. | Type electrode | Plating bath | Cell voltage (V) 20 A/dm$^2$ | Cell voltage (V) 50 A/dm$^2$ | Increase of cell voltage after 200 hours of electrolysis (50 A/dm$^2$) |
|---|---|---|---|---|---|
| 1 | Raney nickel type surface | No treatment | 1.63 | 1.86 | 0.10 |
| 2 | enlarged | A | 1.60 | 1.82 | 0.04 |
| 3 | electrode | B | 1.60 | 1.85 | 0.05 |
| 4 | | C | 1.62 | 1.86 | 0.06 |
| 5 | Ultra-fine powder | No treatment | 1.65 | 1.87 | 0.08 |
| 6 | sintered type | A | 1.62 | 1.85 | 0.04 |
| 7 | surface- | B | 1.62 | 1.85 | 0.04 |
| 8 | enlarged | C | 1.63 | 1.87 | 0.06 |

TABLE 1-continued

| No. | Type electrode | Plating bath | Cell voltage (V) 20 A/dm$^2$ | Cell voltage (V) 50 A/dm$^2$ | Increase of cell voltage after 200 hours of electrolysis (50 A/dm$^2$) |
|---|---|---|---|---|---|
| | electrode | | | | |

No. 1 & 5: Comparative example and No. 2–4, 6–8: Example

It is noted from Table 1 that the electrolysis by use of the positive electrodes treated by the method of this invention proceeded at low cell voltages and showed no marked voltage increase over long periods of operation as compared with the positive electrodes not treated by this invention. Thus, the effect of the present invention is conspicuous.

What is claimed is:

1. A method for the production of a positive electrode for the electrolysis of water, characterized by immersing a nickel electrode in an aqueous solution containing a nickel salt, a rhodium salt, and an alkylamine borane and having the nickel salt and the rhodium salt in amounts such that the molar ratio of nickel to rhodium falls in the range of from 0.01 to 2.0.

2. The method according to claim 1, wherein the nickel electrode to be immersed in the aqueous solution is a surface-enlarged nickel electrode.

3. The method according to claim 1 or claim 2, wherein the aqueous solution is an ammonia water.

4. The method according to claim 1 or claim 3, wherein the aqueous solution is used at a pH value in the range of from 7 to 14 and at a temperature in the range of from 50° to 90° C.

* * * * *